United States Patent [19]

Bublitz

[11] 4,211,338

[45] Jul. 8, 1980

[54] CONTAINER CLOSURE STRUCTURE

[75] Inventor: Robert F. Bublitz, Chester, Va.

[73] Assignee: Reynolds Metals Company, Richmond, Va.

[21] Appl. No.: 47,358

[22] Filed: Jun. 11, 1979

Related U.S. Application Data

[63] Continuation-in-part of Ser. No. 37,036, May 8, 1979, abandoned.

[51] Int. Cl.[2] ..... B65D 41/00

[52] U.S. Cl. ..... 220/359; 220/85 B; 229/3.5 MF; 229/43

[58] Field of Search ..... 220/359, 66, 74, 85 B; 229/3.5 MF, 43

[56] References Cited

U.S. PATENT DOCUMENTS 3,519,439 7/1970 Dunn ..... 229/3.5 MF X 3,850,340 11/1974 Siemonsen et al. ..... 220/74

*Primary Examiner*—George T. Hall

*Attorney, Agent, or Firm*—Glenn, Lyne, Girard, Clark & McDonald

[57] ABSTRACT

A flexible container closure, which is preferably formed of a metallic foil, is disclosed. This closure has a generally planer peripheral surface which may be sealed by either adhesive bonding or heat sealing to a container body. The closure includes an initially inwardly concave central portion which, in combination with the container walls, defines the container volume. This inwardly concave portion is capable of deformation upon increased pressure within the container to increase the volume of the container and reduce the internal pressure therein. By employing the closure structure of the present invention, the chances of leakage failure in the seal between the closure and the container body is substantially reduced.

16 Claims, 7 Drawing Figures

CONTAINER CLOSURE STRUCTURE

CROSS-REFERENCE TO RELATED APPLICATIONS

This is a continuation-in-part of U.S. application Ser. No. 37,036, filed May 8, 1979; now abandoned.

BACKGROUND OF THE INVENTION

Containers for numerous materials, such as drug doses and the like, are formed from such materials as metallic foils, including aluminum foil, molded plastics and the like. These containers may be formed with a generally planer lip at the top thereof to accept a closure thereon by either adhesive bonding or heat sealing. One such container is that disclosed in U.S. Pat. Nos. 3,695,084 and 3,850,340, which are assigned to the assignee of the present invention and which are incorporated herein by reference.

Such containers have in the past been covered by generally planer closures which themselves may be formed of metallic foils, such as aluminum foil, which are coated with either adhesive bonding material or a heat sealable coating at their peripheral edges to be affixed to the generally planer lip of the container body.

A problem with the employment of such planer flexible lids is the tendency for failure of the adhesive bond or heat seal along the lip of the container. Such failure results in the leakage of the contents within the container and, especially in drug and food uses, in contamination of the product so as to make the product unsuitable for sale and use. Also, failure of this seal may result in evaporation of the product held by the container and/or a change in the characteristics of the product.

These failures may occur from either or both of two separate conditions. First, leakage may occur due to seepage of the product within the container between the container lip and the closure. Second, leakage may occur in containers holding products under conditions of elevated temperature. As the temperature increases in the surroundings of the container, pressure may build up within the container. This pressure may become sufficient to overcome either the adhesive bond or the heat seal between the lip of the container and the closure and cause failure of the seal at that point. In either of these situations, such leakage results in an unacceptable container for sale or use. It is desirable, therefore, to provide a container closure for such flat lipped containers which may be either adhesively bonded or heat sealed to the generally planer lip of the container and which reduces substantially the failures caused by leakage, whether the leakage be due seepage or increased pressure within the container.

THE PRESENT INVENTION

By means of the present invention such a closure is provided. The closure of the present invention is a flexible membrane which may be formed of such materials as foils, plastic films and the like and combinations of these materials. Preferably, the closure is formed of aluminum foil which is coated along the peripheral edge of the closure with a material to permit either adhesive bonding or heat sealing of the closure to the generally planer lip of the container. The closure is initially inwardly concave with respect to the top surface of the container, except in the region of the peripheral edge of the closure and lip of the container, when the closure is initially sealed to the container. The closure is flexible and may be deformed under increased pressure within the container to reduce the buildup of pressure within the container and help prevent leakage from the seal.

BRIEF DESCRIPTION OF THE DRAWINGS

The closure and container of the instant invention will be more fully described with reference to the drawings in which.

DETAILED DESCRIPTION OF THE PREFERRED EMBODIMENT

Figure 1:
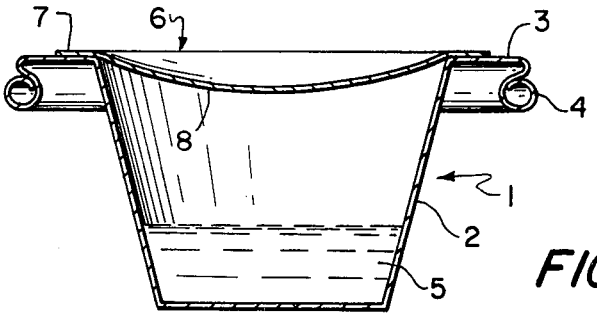
FIG. 1 is a cross-sectional view of a container according to the instant invention just after sealing of the closure to the container body.

Turning to FIG. 1, a container according to the instant invention is illustrated just subsequent to sealing. The container body 1 has a side wall 2, a generally planer lip or rim 3 and a bead 4. The container 1 can be of any desired shape, such as square, rectangular, round or polygonal in its top cross-sectional or top planer view. As shown, the container 1 has a round top planer view. The container 1 may be formed of such materials as molded plastics or metallic foils, such as aluminum foil, and is preferably formed of a metallic foil, such as aluminum foil, which has been coated or laminated with a suitable material, such as polyvinyl chloride or other resinous or thermoplastic materials, to accept a sealed closure thereon.

Attached to the lip or rim 3 of the container 1 is a closure or cover 6. This closure 6 includes an edge portion 7 around its periphery and a central portion 8.

The closure 6 may be formed of numerous materials, such as plastics films, metallic foils and the like. Preferably, the closure 6 is formed of a coated aluminum foil as will be described below. The closure 6 is coated along its bottom surface, either in its entirety, or, preferably, at its peripheral edge 7 with a material to either adhesively bond or heat seal to the rim or lip 3 of the container 1.

The central portion 8 of the closure 6 is initially inwardly concave when the closure 6 is placed on the container body 1. By inwardly concave, it is meant that the closure 6 reduces the available volume of the container 1 below that which the container 1 would have if a flat or planer closure were placed on the rim or lip 3. The inwardly concave central portion 8 may be a portion of a sphere, a parabola, or may take any desired shaped configuration, as will be described below. It has been suggested that one desirable shape for this inwardly concave central portion 8 is eliptical. The shaping of the inwardly concave central portion 8 will also be described below.

Figure 2:
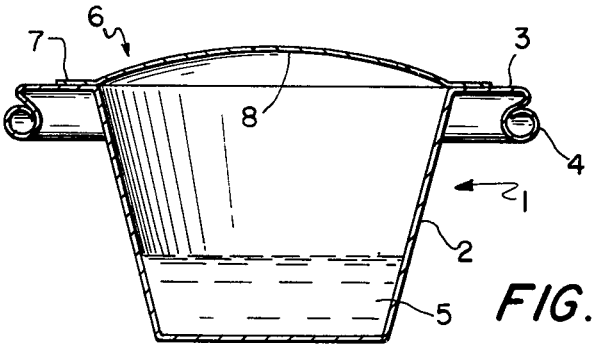
FIG. 2 is a cross-sectional view of the same container with the closure having been deformed to relieve pressure within the container.

FIG. 2 illustrates the container 1 with the closure 6 having been deformed to an inwardly convex position to relieve internal pressure within the container 1.

Pressure will build up within the container 1 if the container 1 is exposed to temperatures above those temperatures in the environment to which the container 1 was exposed during sealing thereof. Such internal pressure may result from pressure buildup in the head space above the product 5, or may result from containing a volatile product 5. In the past, using generally planer closures, such increases in pressure often caused a break in the seal between the lip 3 of the container 1 and the peripheral edge 7 of the closure 6. However, using the flexible closure 6 of the instant invention, increased pressure buildup within the container 1 is relieved by the deformation of the closure 6 from its initially inwardly concave position shown in FIG. 1 to increase the volume enclosed by the closure 6 and thus reduce substantially the pressure within the container 1. It should be noted that the central portion 8 may not fully deform to the position shown in FIG. 2, but will deform sufficiently to reduct the pressure within the container 1. Such pressure relief substantially reduces leakage due to rupture of the seal between the rim 3 of the container body 1 and the peripheral edge 7 of the closure 6.

This is not, however, the only reason for employing the inwardly concave closure 6. As previously mentioned, failure due to pressure is not the only cause of rupture in the seal between the rim 3 of the container 1 and the peripheral edge 7 of the closure 6. Seepage of the product 5 between the rim 3 and the peripheral edge 7 of the closure 6 may also cause leakage.

Figure 7:
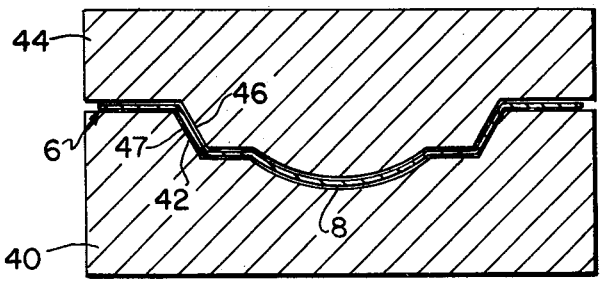
FIG. 7 illustrates an alternative method for shaping the closure of the instant invention.

When using the inwardly concave closure 6 of the present invention, however, seepage is reduced, since the joint between the side wall 2 of the container body 1 and the lip 3 of the container body 1 is partially or entirely covered by the inwardly concave portion 8 of the closure 6. This retards the ability of the product 5 within container 1 to seep into the seal between the rim 3 and the peripheral edge 7 and thus reduces substantially the chances of leakage and failure caused in this manner. If desired, the inwardly concave portion 8 may be formed to closely conform, or even be adhered to, a portion of the side wall 2 to further reduce the chances of leakage due to seepage. FIG. 7 illustrates the formation of a closure 6 which includes a portion 47 which will closely conform to the side wall 2 of the container 1. The formation of this closure 6 will be described below.

Figure 3:
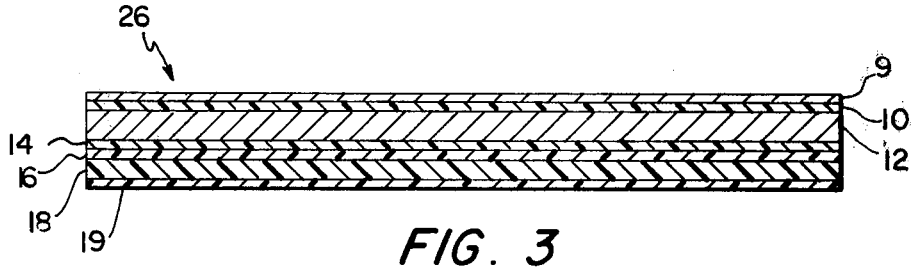
FIG. 3 is a cross-sectional view of one embodiment of a suitable base material for the closure of the instant invention.

FIG. 3 is a cross-sectional view illustrating one embodiment of a suitable base material 26 from which the closure 6 may be produced. Beginning from the uppermost layer, the material 26 includes an optional layer of printing 9 which may be used to identify the product within the container 1, if desired; a wash coat 10, formed of such materials as shellac and materials with polyvinyl chloride as the main or sole ingredient thereof and having a weight ranging from about 0.02 to 0.10 pounds (0.009072 to 0.04536 kilograms) per ream and about 0.1 to 0.5 pounds (0.04536 to 0.22680 kilograms) per ream, respectively; a layer 12 of a metallic foil, such as aluminum foil, ranging in thickness from about 0.0015 to 0.0035 inches (0.00381 to 0.00889 centimeters); a coating layer 14 formed of a material of which polyvinyl chloride is the main or sole ingredient thereof and coated onto the aluminum foil layer 12 in an amount of about 0.2 to 1.0 pounds (0.09072 to 0.4536 kilograms) per ream; an adhesive layer 16 formed of such materials as a thermoset polyester or a thermoset polyurethane material or a thermoplastic material of which polyvinyl chloride is the main or sole ingredient thereof and having a weight ranging from about 1.0 to 3.0 pounds (0.4536 to 1.3608 kilograms) per ream; a polyvinyl chloride or polyolefin film 18 having a thickness ranging from about 0.00075 to 0.003 inches (0.001905 to 0.00752 centimeters) and a sealing layer 19, which may be a heat sealable and pealable coating having polyvinyl chloride as the main or sole ingredient thereof or an adhesively sealable coating, being coated onto the film layer 18 in an amount of from about 0.5 to about 5.0 pounds (0.2268 to 2.268 kilograms) per ream, or a wax coating being coated onto the film layer 18 in an amount of from about 0.5 to 9.0 pounds (0.2268 to 4.0824 kilograms) per ream.

Figure 4:
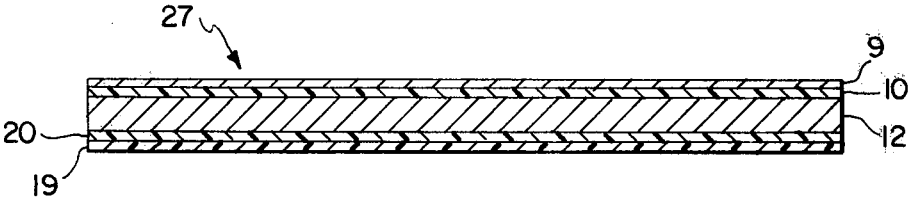
FIG. 4 is a cross-sectional view of a second embodiment of a suitable base material for the closure of the instant invention.

FIG. 4 illustrates an alternate base material 27 which may also be used to form the closure 6 of the instant invention. This material 27 may include the same optional printing layer 9, and includes the same wash coat layer 10 and aluminum foil layer 12 as the material 26 of FIG. 3. Unlike the material 26, however, the material 27 includes no adhesive or film layers. Rather, the material 27 has a base coat layer 20 formed of a material having polyvinyl chloride as the main or sole ingredient in an amount of about 0.5 to 2.0 pounds (0.2268 to 0.9072 kilograms) per ream and the adhesive or heat sealable and pealable layer 19 coated onto the base coat layer 20.

Figure 5:
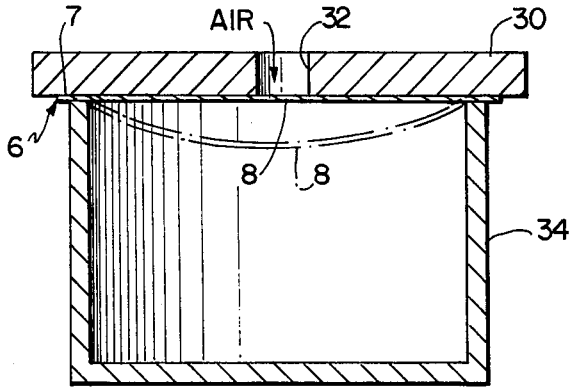
FIG. 5 illustrates a first method for shaping the closure of the instant invention.
Figure 6:
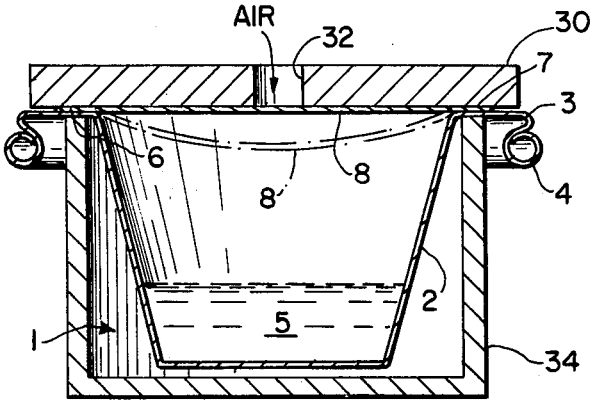
FIG. 6 illustrates a second method for shaping the closure of the instant invention.

Suitable methods for shaping the sheet materials 26 or 27 into the closure 6 are illustrated in FIGS. 5, 6 and 7.

Turning to FIG. 5, a closure 6 has been cut from a sheet of either the sheet material 26 or 27 by means well-known to those skilled in the art, such as die cutting or roller cutting. The closure 6 is held along its peripheral edge 7 by means of a back-up die 34. The back-up die 34 holds the peripheral edge 7 of the closure 6 against a generally planer plate 30 which includes an opening 32 therein. Gaseous fluid, such as air, is forced under pressure, which may range from about 10 to 50 psig (7,031 to 35,155 kilograms per square meter), through the opening 32 from means (not shown) to form the inwardly concave section 8 from its initially flat or planer position. Such a method will produce a concave portion 8 which is parabolic if the closure 6 is circular, and will produce a generally rounded shape, depending upon the shape of the closure 6.

FIG. 6 illustrates the formation of the generally concave portion 8 of the closure 6 in the same manner, but with the container 1 being located within the back-up die 34. When the container 1 is placed within the die 34, the die 34 supports the rim portion 3 of the container 1 and holds the rim portion 3 and the peripheral edge 7 of the closure 6 firmly together while the gas pressure through opening 32 forms the inwardly concave portion 8 of the closure 6. This method is especially useful when it is desired to at least partially form the concave portion 8 about the junction of the side wall 2 and the rim 3 to reduce the chance of leakage due to seepage, as previously mentioned.

FIG. 7 illustrates another method of shaping the closure 6. In this method, a generally planer closure 6 is shaped between a male die 44 and a female die 40 to give a shaped concave portion 8. As illustrated, the male die 44 and female die 40 include a ridge portion 46 and 42 respectively between which is formed a generally frustoconical section 47 of the concave portion 8. This section 47 may be sealed to the inner portion of side wall 2 of the container 1 to further reduce the possibility of failure due to seepage. Clearly, when using matched dies as in FIG. 7, any desired concave shape may be formed to accommodate any desired container construction.

From the foregoing, it is clear that the present invention provides a flexible container closure which reduces the possibility of leakage and increases the reliability of the container.

While the present preferred embodiments of the invention have been illustrated and described, it will be understood that the invention may be otherwise variously embodied and practiced within the scope of the following claims.

I claim:

1. A container closure for use on a container body having a planer sealing surface comprising a flexible sheet material having a planer peripheral sealing portion and a shaped central portion, said shaped central portion being initially concave with respect to said container body onto which said closure is to be sealed and said shaped central portion being capable of being deformed under internal pressure within said container body after sealing of said closure onto said container body without damage to the seal between said planer sealing surface of said container body and said planer peripheral sealing portion of said closure.

2. The closure of claim 1 wherein said closure comprises a metallic foil.

3. The closure of claim 2 wherein said closure comprises aluminum foil.

4. The closure of claim 1 wherein said closure comprises a plastic sheet material.

5. The closure of claim 1 wherein said closure includes a heat sealable coating on said peripheral sealing portion of said closure.

6. The closure of claim 1 wherein said closure includes an adhesive bondable coating on said peripheral sealing portion of said closure.

7. The closure of claim 1 wherein said shaped central portion is shaped into a portion of a sphere.

8. The closure of claim 1 wherein said shaped central portion is shaped into a parabola.

9. In a container construction comprising a container body having a bottom wall, a side wall and a planer sealing surface and a closure sealed to said planer sealing surface of said container body, the improvement wherein said closure comprises a flexible sheet material having a planer peripheral sealing portion and a shaped central portion, said shaped central portion being initially concave with respect to said container body and said shaped central portion being capable of being deformed under internal pressure within said container construction without damage to the seal between said planer sealing surface of said container body and said planer peripheral sealing portion of said closure.

10. The container construction of claim 9 wherein said closure comprises a metallic foil.

11. The container construction of claim 10 wherein said closure comprises aluminum foil.

12. The container construction of claim 9 wherein said closure comprises a plastic sheet material.

13. The container construction of claim 9 wherein said closure includes a heat sealable coating on said peripheral sealing portion of said closure.

14. The container construction of claim 9 wherein said closure includes an adhesive bondable coating on said peripheral sealing portion of said closure.

15. The container construction of claim 9 wherein said shaped central portion of said closure is shaped into a portion of a sphere.

16. The container construction of claim 9 wherein said shaped central portion of said closure is shaped into a parabola.

* * * * *